US006568009B2

(12) United States Patent
Linger et al.

(10) Patent No.: US 6,568,009 B2
(45) Date of Patent: May 27, 2003

(54) LARGE BODY STRETCHER

(75) Inventors: David R. Linger, Loveland, OH (US); James N. Chinn, Roswell, GA (US); Irvin D. Pollock, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 111 days.

(21) Appl. No.: 09/816,583

(22) Filed: Mar. 23, 2001

(65) Prior Publication Data

US 2001/0044966 A1 Nov. 29, 2001

Related U.S. Application Data

(60) Provisional application No. 60/191,705, filed on Mar. 23, 2000.

(51) Int. Cl.[7] ..... A61G 1/013
(52) U.S. Cl. ..... 5/627; 128/870
(58) Field of Search ..... 5/625, 627, 626, 5/312, 620, 628; 128/870

(56) References Cited

U.S. PATENT DOCUMENTS

| | | | | | |
|---|---|---|---|---|---|
| 456,547 | A | * | 7/1891 | Brew | 5/627 |
| 529,301 | A | * | 11/1894 | Ortega | 5/627 |
| 1,072,052 | A | * | 9/1913 | Stoehr | 5/626 |
| 1,201,785 | A | * | 10/1916 | Williams | 5/627 |
| 1,286,328 | A | * | 12/1918 | Hubbard | 5/627 |
| 1,396,208 | A | | 11/1921 | Hubbard | |
| 1,871,680 | A | * | 8/1932 | Flanagan | 5/627 |
| 2,276,256 | A | * | 3/1942 | Visness et al. | 5/627 X |
| 2,333,062 | A | * | 10/1943 | Visness et al. | 5/627 |
| 2,350,573 | A | * | 6/1944 | Smith, Jr. et al. | 5/627 |
| 2,379,365 | A | * | 6/1945 | Levison | 5/627 |
| 2,449,767 | A | * | 9/1948 | Carpenter | 5/627 X |
| 2,999,251 | A | * | 9/1961 | Hedges | 5/627 |
| 3,648,305 | A | * | 3/1972 | Ersek | 5/625 X |
| 3,886,606 | A | | 6/1975 | Bradford | |
| 3,973,281 | A | * | 8/1976 | Davis et al. | 5/131 |
| 4,128,907 | A | * | 12/1978 | Gelbart | 5/200.1 |
| 4,369,982 | A | * | 1/1983 | Hein et al. | 280/47.131 |
| 4,670,921 | A | | 6/1987 | Avni et al. | |
| 4,799,274 | A | * | 1/1989 | Dommerud | 5/620 |
| 4,947,418 | A | * | 8/1990 | Barr et al. | 5/601 X |
| 5,473,784 | A | * | 12/1995 | Nixon et al. | 5/625 |
| 5,566,409 | A | * | 10/1996 | Klearman | 5/723 |
| 5,704,081 | A | | 1/1998 | Bollinger | |
| 5,803,087 | A | | 9/1998 | Thompson | |
| 5,813,629 | A | * | 9/1998 | Cabrera | 244/118.6 |
| 5,934,282 | A | | 8/1999 | Young, III et al. | |
| 6,079,072 | A | * | 6/2000 | Katsiri | 14/2.4 |

FOREIGN PATENT DOCUMENTS

| | | |
|---|---|---|
| EP | 0136977 | 4/1985 |
| EP | 0263628 | 4/1988 |

* cited by examiner

*Primary Examiner*—Heather Shackelford
*Assistant Examiner*—Sunil Singh
(74) *Attorney, Agent, or Firm*—Killworth, Gottman, Hagan & Schaeff, L.L.P.

(57) ABSTRACT

A large body stretcher dimensioned to accommodate large-bodied persons and foldable to conserve space. The stretcher provides a patient support surface comprising a first board and a second board that are secured together and foldable along a longitudinal axis. The stretcher may conveniently be secured, via a securing arrangement, to a host cot. The stretcher further provides rotatable backrest portions that permit the backrest of the host cot to be raised in order to assist patients who can benefit from being transported in an upright or seated position. The stretcher further provides a plurality of retaining channels so that the restraining straps of the host cot are available for use with a patient placed upon the large body stretcher. Handholds are provided to allow convenient use of the stretcher as a standalone apparatus.

11 Claims, 6 Drawing Sheets

LARGE BODY STRETCHER

CROSS REFERENCE TO RELATED APPLICATIONS

This application claims the benefit of the following U.S. Provisional Application: Ser. No. 60/191,705 for Large Body Stretcher, filed Mar. 23, 2000.

BACKGROUND OF THE INVENTION

The present invention relates in general to foldable stretchers, and in particular to a foldable large platform stretcher capable of extending over and securing to an ambulance cot in order to accommodate safely a patient with a large body.

Foldable stretchers are often used to transport patients from the scene of an accident to an emergency vehicle, such as, for example, an ambulances or a helicopter. Such stretchers are often dimensioned similar to that of a standard rollable ambulance cot and provide only a patient litter in order to be as lightweight as possible. Therefore, in most situations, the patient is transferred from the stretcher to the rollable ambulance cot in order to safely secure the patient thereon for transport to a medical facility.

However, ambulance cots are not always suited to accommodate the medical needs of persons with large bodies. Often times, it is difficult to place a large-bodied patient in the cot, and sometimes the cot cannot accommodate the large-bodied person at all. In those situations, the portable stretcher is then often placed on top of the ambulance cot in an unsecured or jerry-rigged fashion. Once the patient is loaded into the transport vehicle, even though the ambulance cot is locked into place with the provided securing devices that mate securely with the transport vehicle, there is still a need to better secure the patient within the transport vehicle for safe transport to the medical facility. The lack of a means to safely and securely transport a large-bodied patient can degrade the quality of medical care provided to them.

Further, the compact nature of both conventional foldable stretchers and ambulance cots often provides little extra space for emergency equipment, such as oxygen tanks, intravenous medications, cardio monitors and the like which are required for immediate treatment. These devices are often placed on the empty spaces of the cot's mattress without compromising the patient carried thereon. However, with a large-bodied patient, the lack of available mattress space can lead to distractions to the emergency care provider, clutter in the transport vehicle, and general difficulty during transportation of the patient.

Finally, in those situations when the stretcher is provided on top of the ambulance cot, the ability to prop the patient into an upright or seated position is difficult and often unavailable. The inability of positioning the patient in such a manner can degrade the quality of medical care provided to them.

Accordingly, there is a need for a stretcher adapted to provide a secure and enlarged platform to accommodate large-bodied patients, medical devices and the like. There is also a need for a stretcher which may be used as a standalone apparatus, or which can be mounted easily and securely to an ambulance cot. There is a further need for a stretcher capable of permitting patients to be transported in an upright or seated position.

SUMMARY OF THE INVENTION

These needs are met by the present invention providing a foldable stretcher dimensioned to accommodate large-bodied persons that can be used as a stand-alone stretcher/backboard, or be mounted quickly and securely to an ambulance cot. The stretcher provides a patient support surface comprising a first board and a second board. The first board and the second board are rotatably secured together along a longitudinal side, such that the first portion is foldable over the second portion to conserve space.

The stretcher further provides a securing arrangement that permits the stretcher to be mounted to a host cot. The securing arrangement comprises legs that mate securely with docking ports or receptacle members mounted to the host cot. In one embodiment, the legs are rotatably mounted to the underside of the stretcher such that they may be movable from an extended position and a stowed position. In another embodiment, the legs are removably mounted to mounting channels provided in the stretcher. The stretcher also comprises a backrest portion that, upon securing the stretcher to the host cot, permits the backrest of the host cot to be raised in order to assist patients who can benefit from being transported in an upright or seated position. Additionally, the stretcher comprises a plurality of retaining channels so that separate restraining straps or the restraining straps of the host cot are available for use with a patient placed upon the large body stretcher. Furthermore, handholds are provided to allow convenient use of the stretcher as a standalone apparatus. Finally, an extender board may used to expand the lateral dimension of the stretcher.

In accordance with one embodiment of the present invention, provided is a stretcher attachable to a host rollable cot with a raisable backrest. The stretcher comprises a first board having a first backboard portion and a second board having a second backboard portion. The second board is hinged to the first board along a longitudinal side such that the first and second boards are movable between a first condition in which the first and second boards form a substantially planar patient support surface, and a second condition in which the first and second boards are folded against each other. The first and second backboard portions are rotatably mounted to the first and second boards, respectively, and configured to permit the backrest of the host rollable cot to be raised when the stretcher is provided thereon in the first condition.

In accordance with another embodiment of the present invention, provided is a stretcher comprising a first board having a first plurality of finger and knuckle portions, and a second board having a second plurality of finger and knuckle portions. The second board is hinged to the first board along a longitudinal side such that the first and second boards are movable between a first condition in which the first and second boards are folded against each other, and a second condition in which the first and second boards form a substantially planar patient support surface. When in the second condition, the first finger portions of the first board rest upon the second knuckle portions of the second board and the second finger portions of the second board rest upon the first knuckle portions of the first portion.

In accordance with still another embodiment of the present invention, provided is a stretcher attachable to a host rollable cot with a raisable backrest. The stretcher comprises a first board having a first backboard portion, and a first plurality of finger and knuckle portions. The stretcher further comprises a second board having a second backboard portion, and a second plurality of finger and knuckle portions. The second board is hinged to the first board along a longitudinal side such that the first and second boards are movable between a first condition in which the first and second boards are folded against each other and a second condition in which the first and second boards form a substantially planar patient support surface. When in the second condition, the first finger portions of the first board rest upon the second knuckle portions of the second board and the second finger portions of the second board rest upon the first knuckle portions of the first portion. The first and second backboard portions are mounted to the first and second boards, respectively, and configured to permit the backrest of the host rollable cot to be raised when the stretcher is provided thereon in the first condition.

Other features and advantages of the present invention will be apparent in light of the description of the invention embodied herein.

BRIEF DESCRIPTION OF THE DRAWINGS

The following detailed description of the embodiments of the present invention can be best understood when read in conjunction with the accompanying drawings, where like structure is indicated with like reference numerals, and in which.

DETAILED DESCRIPTION OF THE PREFERRED EMBODIMENTS

Figure 1:
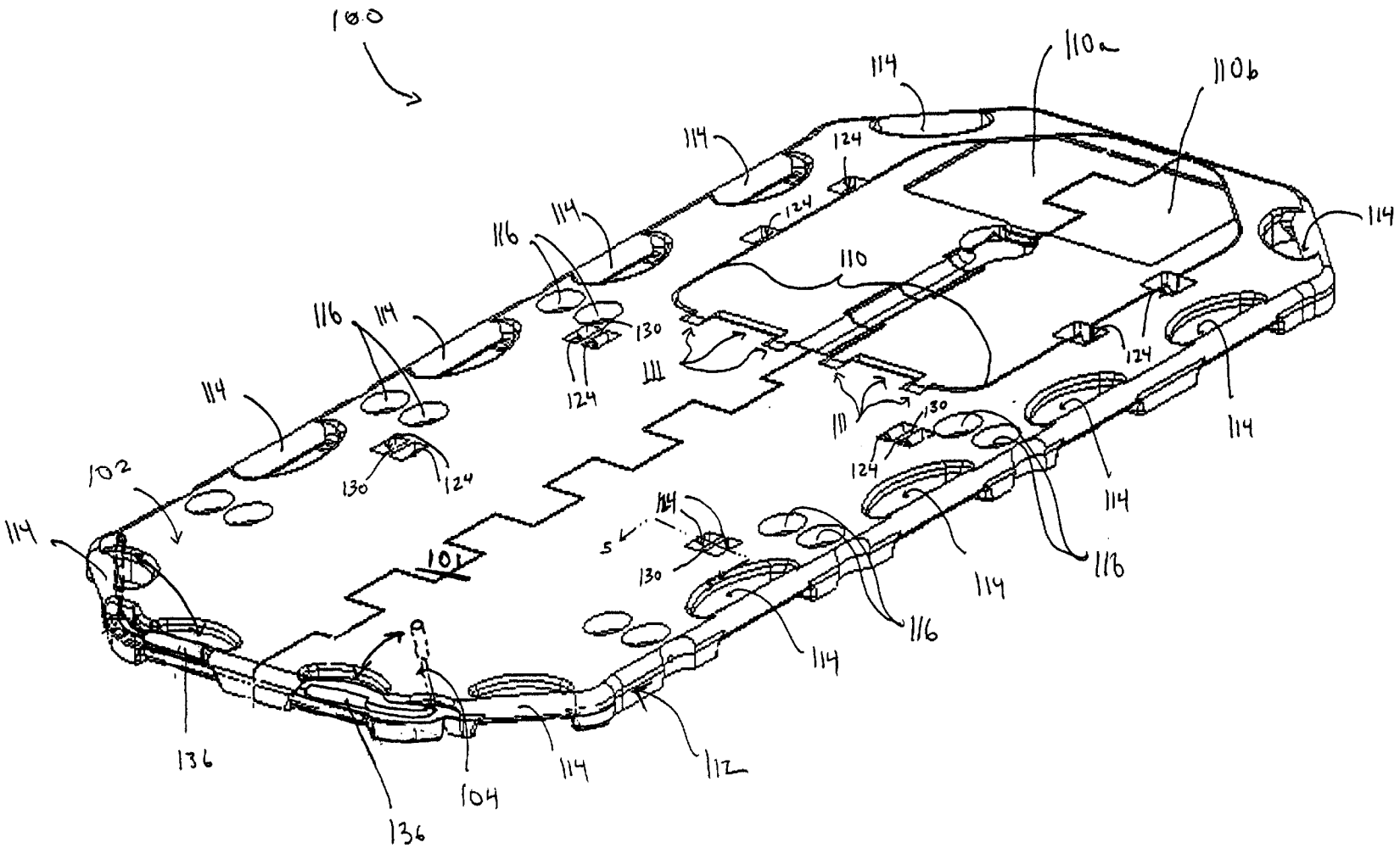
FIG. 1 is a front perspective view of a large body stretcher according to the present invention.
Figure 2:
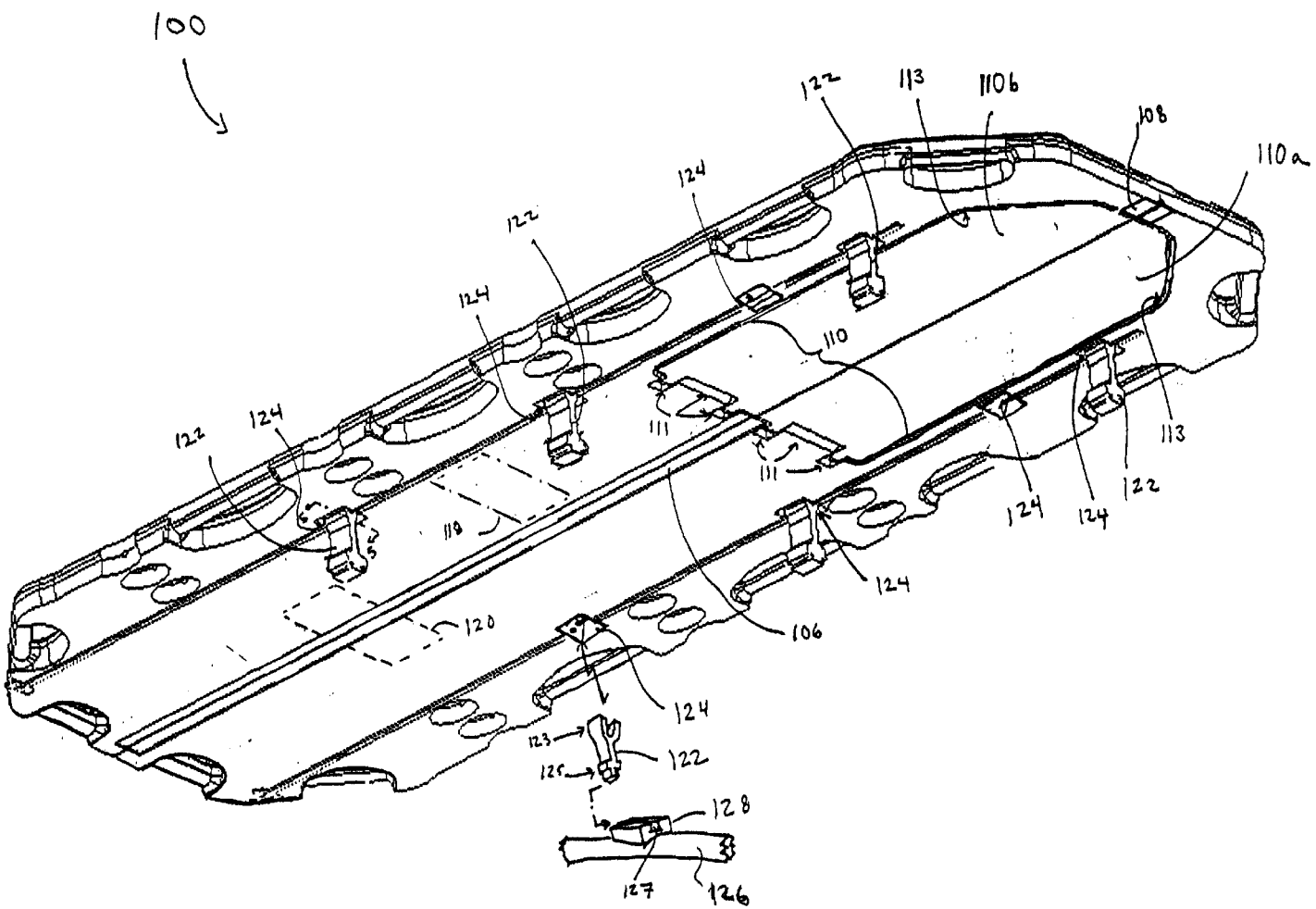
FIG. 2 is a back perspective view of the large body stretcher of FIG. 1, illustrating an optional structural support arrangement.

Front and back perspective views of a large body stretcher 100 according to the present invention are shown by FIGS. 1 and 2. The stretcher 100 when fully unfolded in a first condition as shown provides a substantially planar patient support surface 101 that comprises a first board 102 and a second board 104. First and second hinges 106 and 108 connect the first board 102 and the second board 104 along opposed longitudinal sides 103 such that the first and second boards may fold back against each other to a second condition indicated by the dashed lines in FIG. 3, thereby conserving space. For other embodiments, the first board 102 may connect to the second board 104 with other securing arrangements such as, for example, bolting, pinning, screwing and the like.

Figure 3:
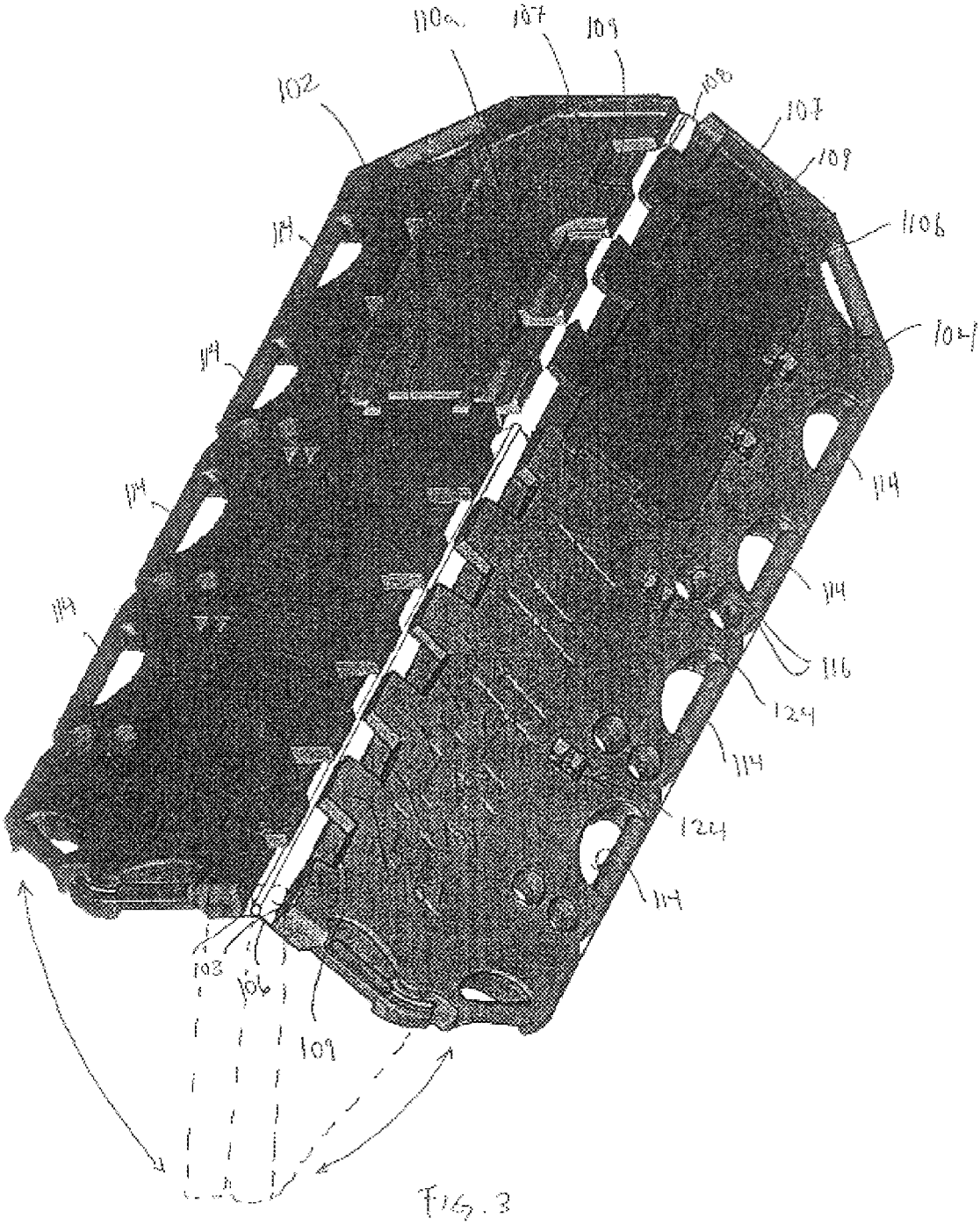
FIG. 3 is a front perspective view of a large body stretcher according to the present invention partially folded.

The first and second hinges 106 and 108 provide structural support to the stretcher when in the fully unfolded condition providing the patient support surface 101. Additional structural support is provided to the stretcher 100 by the hinged side 103 of each board 102 and 104 having integral finger and knuckle portions 107 and 109, respectively, which is best illustrated by FIG. 3. The finger and knuckle portions 107 and 109 alternate such that each of the finger portions 107 of the first and second boards 102 and 104 rests upon a corresponding knuckle portion 109 provided on the opposing board, thereby adding supportive strength and spinal support to the stretcher 100 when positioned in the first condition.

The lateral width of the stretcher 100 is such to permit the stretcher to maneuver through common doorways, and is preferably about 34 inches. Additionally, such a lateral dimensioning would also permit the stretcher 100 to fold and easily stow, such as, for example, in an existing backboard compartment in a typical ambulance. Furthermore, while the stretcher 100 is generally suited for carrying large persons, the extra lateral dimensions of the platform make it ideally suited to providing additional surface area for equipment, including cardio equipment, intravenous equipment, and the like. Often times, extra equipment is required in the treatment of a patient. Where hoses, tubes, electronic devices and the like are used, it is preferable to place the equipment as near the patient as possible, to avoid inadvertently bumping into such equipment by the emergency care givers while working in the narrow constraints of an emergency vehicle. Moreover, it should become apparent to those skilled person skilled in related art, that the stretcher 100 may also be used advantageously as a field table, such as used for triage, operations, decontaminations, and the like.

The longitudinal length can be selected to meet the needs of the specific user requirements, and further, to meet any specialized needs of a host rollable cot 126 (FIG. 4), such as those carried by an ambulance, such that the stretcher 100 may mount thereon. For example, a preferably length of approximately 76 inches would be suitable for a number of applications.

Figure 4:
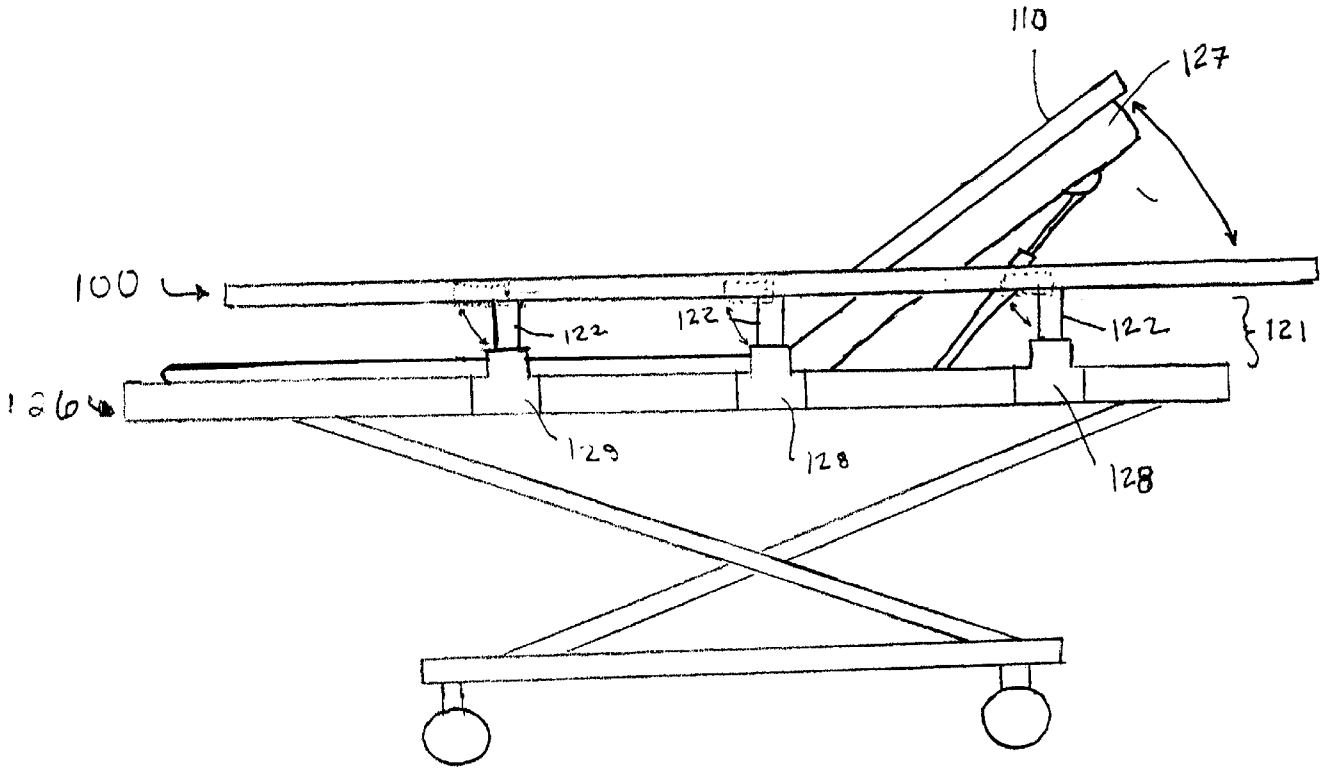
FIG. 4 is a side illustrative view of a large body stretcher secured to a host cot according to the present invention.

The first and second boards 102 and 104 each include a backrest portion 110*a* and 110*b*, respectively. Each backrest portion 110*a* and 110*b* is rotatably mounted to its respective board 102 or 104 at an end via a hinging arrangement 111. The hinging arrangement 111 permits each backrest portion to rotate about a lateral axis from a position flush with its respective board as illustrated in FIG. 1, to a raised position as illustrated in FIG. 4. A supportive edge 113 (FIG. 2) of each board 102 and 104, and integral finger and knuckle portions 107 and 109 of each backrest portion 110*a* and 110*b* operate together to prevent the backrest portions from rotating below the patient support surface 101. Additionally, the supportive edge 113 and the finger and knuckle portions 107 and 109 provide support to the backrest portions when the stretcher 100 is in the fully unfolded condition.

With the stretcher 100 fully unfolded, the backrest portions 110*a* and 110*b* together form a rotatable backrest 110. As illustrated by FIG. 4, the rotatable backrest 110 permits the host cot's backrest 127 to be placed in a raised position when the stretcher 100 is secured to the host cot 126 such that a patient carried thereon may be positioned in an upright or seated position. In another embodiment, each backrest portion 110*a* and 110*b* is removably attached to its respective board such that it maybe removed, if desire, to permit the backrest 127 of the host cot 126 to be raised through the space therein provided in the stretcher 100.

Preferably, the maximum load capacity for the platform 100 is about 600-pound. In order to allow attendants to carry a large-bodied patient of about 600-pounds upon the patient support surface 101, the stretcher 100 contains a plurality of handholds 114 spaced around and adjacent to the stretcher's periphery 112. For other embodiments, the maximum load capacity and number of handholds can vary depending upon the required application and stretcher dimensions. It is to be appreciated that the handholds 114 are provided adjacent the patient support surface 101 such that the handhold 114 are spaced a distance for the work surface upon which the stretcher is supported. Such a handhold arrangement allows the attendants to grasp more easily the handholds 114 and to gain a mechanical advantage for lifting the stretcher 100. In other embodiments, integral footpads positioned along the back or underside of the stretcher 100 may be provided to suspend the stretcher in a slightly raised position with respect to the work surface.

For applications where load capacities are expected above 600 pounds, the stretcher 100 may be provided with movable crossbars in order to further strengthen the stretcher 100 while in the fully unfolded condition. In such an embodiment, the crossbars are positioned substantially laterally along the stretcher where extra support is needed, and are indicated by dashed lines 118 and 120 in FIG. 2. A slot or channel (not shown) can be provided in the boards 102 and 104 to slidably mount the crossbars 118 and 120 to the stretcher 100. In this manner, the crossbars may be moved laterally to extend across the adjacent board when the stretcher 100 is in the fully unfolded condition. The crossbars 118 and 120 can then be secured into place in a conventional manner such as a pin, bolt, or clasp to provide added support to the stretcher 100.

Referring to FIGS. 1 and 2, the stretcher 100 includes a plurality of throughbore-pairs or retaining channels 116 for receiving or passing through straps and like restraining devices while the stretcher 100 is secured to the host cot 126. The retaining channels 116 can be placed anywhere along the surface of the stretcher 100 as desired. The number of retaining channels 116 utilized and the positioning will be dependant upon factors such as the positioning of restraints on the host cot 126 (FIG. 4), and of the needs of the patient.

Referring to FIG. 4, the stretcher 100 further includes a securing arrangement 121 to allow the platform 100 to mount to the host cot 126. In one embodiment, the securing arrangement 121 comprises a plurality of legs 122 rotatably mounted to the underside of the stretcher 100. In this embodiment, the legs 122 fold from a stowed position substantially parallel to the stretcher 100, illustrated by the dashed lines, to an extended position, which places the legs 122 substantially perpendicular to the stretcher 100 as illustrated in FIG. 4. Any suitable locking arrangement can be used to secure the legs 122 in both the extended and stowed positions. With the legs 122 placed in the extended position, the stretcher 100 may then be advantageously releasable mounted to the host cot via receptacle members 128 provided on the host cot 126.

Referring to FIG. 2, in another embodiment, the securing arrangement 121 comprises a plurality of removable Y-shaped legs 122 which are locatable by first ends 123 in mounting channels 124 of the stretcher 100. Second ends 125 of the legs 122 mated with the receptacle members 128 either provided to the host cot 126 directly or secured to the host cot through the use of clamps, bolts or the like. Preferably, the second end 125 of each leg 122 has a dovetail configuration which mates to an oppositely shaped socket 127 of the receptacle member 128, and secures therein, such as with pins, latches, and the like.

Figure 5:
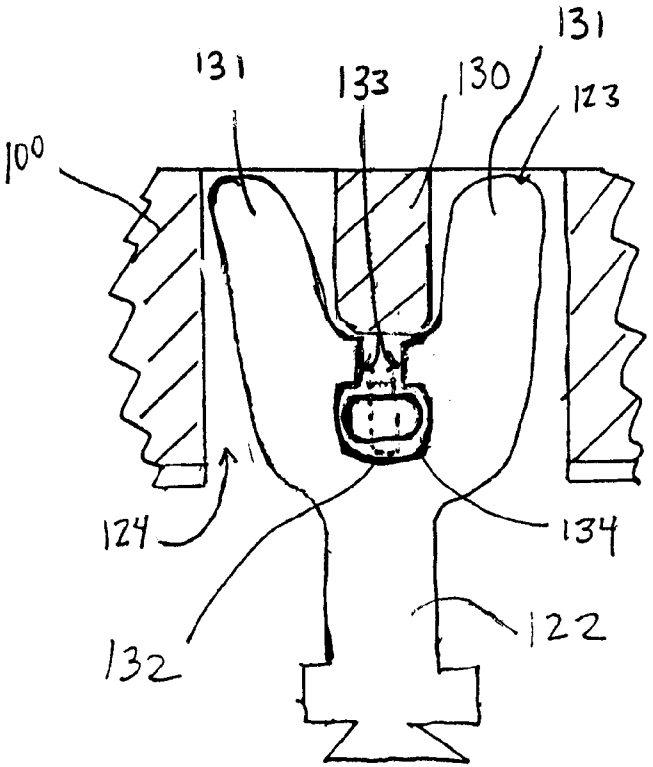
FIG. 5 is a section view taken along section line 5—5 illustrating a removably mounted securing leg of a large body stretcher according to the present invention.

In a preferred use, the legs 122 are mounted first to the host cot 126, via the provided receptacle members 128. Next, the stretcher 100 is positioned down on the legs 122 by looking down through the mounting channels 124 from the support surface 101 of the stretcher 100. As shown in FIG. 5, illustrating a cross section of the stretcher and one of the legs 122 taken along line 5—5, the leg 122 is accommodated in its respective mounting channels 124 such that its first end 123 is engaged between its forks 131 by a brace member 130 of the stretcher. As illustrated in FIG. 1, the brace member 130 spans the width of the mounting channel 124. A securing bar 132 is used to releasably secure the stretcher 100 to the leg 122. It is to be appreciated that for this embodiment, all the legs 122 are secured to the stretcher in the same manner as described above.

In a secure position, the securing bar 132 extends through a securing cavity 134 provided in the leg 122. The securing bar 132 holds the leg 122 fast to the stretcher 100 due to its oval or racetrack shape being unable to slip between a channel 133 provided between the forks 131 of the leg. In a release position, the securing bar 132 is rotated about ninety degrees, which is indicated by the dashed-lines, such that the securing bar 132 may slip through the channel 133, thereby releasing the leg 122 from the mounting channel 124. It is to be appreciated that each board 102 and 104 includes a securing bar 132 that may be manually moved between the secure position and the release position, via included actuators 136 (FIG. 1). Moving one of the actuators 136 from the illustrated secured position to the release position, illustrated by the dashed lines in FIG. 1, rotates the associated securing bar 132 about ninety degrees, thereby permitting the removal of all the legs 122 accommodated within the mounting channels 124 on the respective board 102 or 104. Accordingly, moving the actuators 136 to the secured position, will secure all the legs 122 accommodate within the mounting channels 124 to the stretcher 100.

Figure 6:
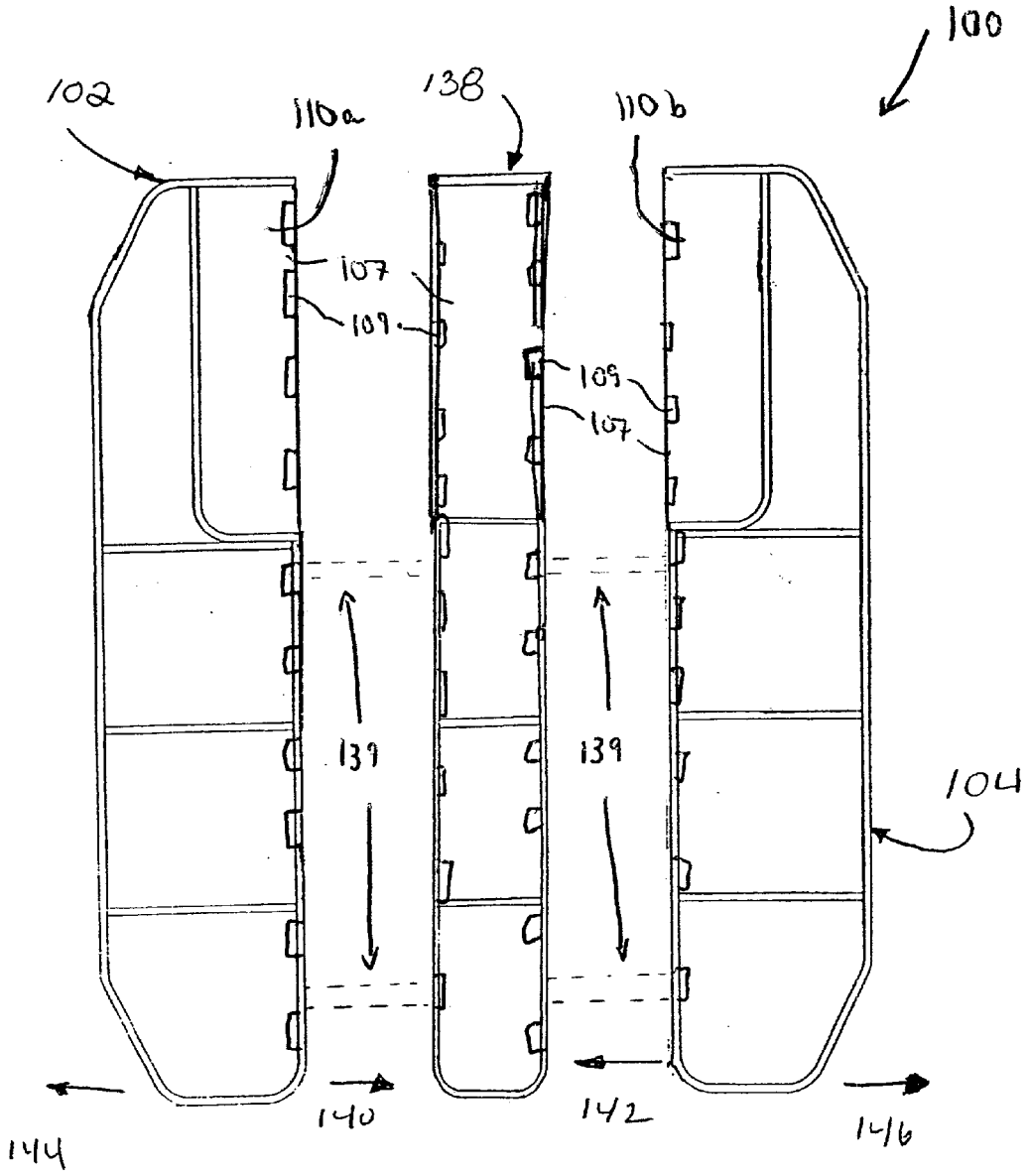
FIG. 6 is an illustration of the large body stretcher of the present invention, illustrating a typical arrangement for an optional lateral extender member.

Referring to FIG. 6, a lateral extender board 138 having also a plurality of finger and knuckle portions 107 and 109 may be provided to extend the dimensions of the stretcher 100 for situations in which an even larger area patient support surface 101 (FIG. 1) is required. In this embodiment, the hinge 106 (FIG. 2) is configured to allow the first board 102 to separate from the second board 104 through the removal of a retaining pin or the like. Additionally, alternative means can be used to releasably secure the first board 102 to the second board 104 including bolts, brackets, clamps, and the like. Preferably, in this embodiment the hinge 106 allows for rapid conversion by releasably securing and permitting the boards 102 and 104 to extend along the longitudinal side 103 (FIG. 3) similar in fashion to the method used to add a centerboard to enlarge a dinning room table. Accordingly, telescoping member lateral support members 139 permit the first board 102 and second board 104 to be extended and retracted. After releasing a locking device holding the boards together along the longitudinal side 103, by applying a force on the first board 102 in the direction of arrow 144, and applying a force to the second board 104 in the direction of arrow 146, the lateral extender board 138 may be placed between the boards. Then transitioning the first and second boards 102 and 104 in the direction of arrows 140 and 142, respectively, the longitudinal edges of the lateral extender board 138 are thereby secured between the boards. Re-securing the locking device will prevent further lateral movement of the boards 102 and 104 while the lateral extender board 138 is in use. In this manner the stretcher 100 can have a nominal lateral dimension, such as for example, of approximately 34 inches in an unfolded position, which then can be extended laterally, such as for example, by an additional 10 inches by inserting lateral extender board 138.

The boards 102 and 104, the backrest portion 110*a* and 110*b*, and the lateral extender boar 138 of the stretcher 100 are made of a molded non-porous material, such as a polymer, and preferably, polyethylene plastic or other suitable material and utilizes a rotational molding procedure. It is to be appreciated that using rotational molding permits the formation of both a lightweight and durable stretcher 100. Additionally, it is to be appreciated that forming the portions of the stretcher 100 by rotation molding also has a number of inherent design strengths, such as consistent wall thickness and strong corners that are virtually stress free. Furthermore, should additional strength be required, reinforcing ribs can be designed and molded into each portion of the stretcher. Alternatively, the portions of the stretcher 100 may be blow molded, injection molded, and/or constructed of metal.

In operation, where an emergency care provider recognizes the need for a large platform, the stretcher 100 is removed from its storage location; for example, a backboard storage compartment provided on an emergency transport. The stretcher 100 is then transported to its desired location. It should be pointed out that the present invention is useable as a standalone stretcher, or as a platform extender for a host cot 126. Therefore, the present invention can be unpacked and immediately assembled to the host cot 126 by unfolding the stretcher 100, positioning it over the host cot 126, and then securing the platform to the host cot 126 using the provided securing arrangement 121.

Alternatively, the stretcher 100 may be transported to the desired location by carrying it in either the folded, or the fully unfolded condition. Upon attaining the desired location, if not already completed, the stretcher 100 is unfolded by unfolding the first portion 102 from the second portion 104. The patient is placed upon the platform 100, secured in place with restraining straps connected or passing through the retaining channels 116, and then lifted by grasping the stretcher 100 along handholds 114.

Upon returning to the ambulance, the stretcher is secured to the host cot 126 using the provided securing arrangement 121. Once the stretcher is secured to the host cot 126, the cot is loaded into the ambulance or other transportation vehicle. Because the stretcher 100 does not interfere with or inhibit locking devices used to secure the host cot 126 within the ambulance, such locking devices may be used in order to transport safely and effectively the patient upon the connected stretcher 100 and host cot 126 to an emergency facility.

In the foregoing specification, the invention has been described with reference to specific exemplary embodiments thereof. It should be appreciated that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A stretcher attachable to a host rollable cot with a raisable backrest, said stretcher comprising:

a first board having a first backboard portion, a continuous exterior side edge, and a sectioned interior side edge, said first backboard portion forming a section of said interior side edge;

a second board having a second backboard portion complimentary to said first board and said first backboard portion, said second board is hinged to said first board along at least a portion of said interior side edge such that said first and second boards are movable between a first condition in which said first and second boards form a substantially planar patient support surface, and a second condition in which said first and second boards are folded against each other, and said first and second backboard portions are rotatably mounted to said first and second boards, respectively, and configured to permit the backrest of the host reliable cot to be raised when said stretcher is provided thereon in said first condition.

2. The stretcher according to claim 1, wherein said first and second boards each provide a plurality of finger and knuckle portions along said interior side edge.

3. The stretcher according to claim 1, wherein said first and second boards each provide a plurality of handholds.

4. The stretcher according to claim 1, wherein said first and second boards each provide a plurality of retaining channels.

5. The stretcher according to claim 1, further comprising a plurality of rotatably mounted legs, said legs are movable between an extended position that places said legs perpendicular to said stretcher when in said second condition and a retracted position which places said legs in parallel with said stretcher.

6. The stretcher according to claim 1, wherein said first and second boards each provide a plurality of mounting channels and said stretcher further include a plurality of legs removably mounted in said mounting channels.

7. A stretcher attachable to a host rollable cot with a raisable backrest, said stretcher comprising:

a first board having a first backboard portion;

a second board having a second backboard portion, said second board is hinged to said first board along a longitudinal side such that said first and second boards are movable between a first condition in which said first and second boards form a substantially planar patient support surface, and a second condition in which said first and second boards are folded against each other, wherein said first and second backboard portions are rotatably mounted to said first and second boards, respectively, and configured to permit the backrest of the host rollable cot to be raised when said stretcher is provided thereon in said first condition, wherein said first and second boards each provide a plurality of mounting channels and said stretcher further include a plurality of legs removably mounted in said mounting channels, and wherein said first and second boards each further comprise a securing bar manually moved between a secure position and a release position, said secure position engages said legs accommodated in said mounting channels with said securing bar, and said release position disengages said securing bar from said legs accommodated in said mounting channels.

8. A stretcher comprising:

a first board having a first plurality of finger and knuckle portions; and a second board having a second plurality of finger and knuckle portions and hinged to said first board along a longitudinal side such that said first and second boards are movable between a first condition in which said first and second boards are folded against each other, and a second condition in which said first and second boards form a substantially planar patient support surface, wherein said first finger portions of said first board rest upon said second knuckle portions of said second board and said second finger portions of said second board rest upon said first knuckle portions of said first portion, wherein said first and second boards each provide a plurality of mounting channels and said stretcher further comprises a plurality of legs removably mounted in said mounting channels, and wherein said first and second boards each further include a securing bar manually moved between a secure position and a release position, said secure position engages said legs accommodated in said mounting channels wit said securing bar, and said release position disengages said securing bar from said legs accommodated in said mounting channels.

9. A stretcher attachable to a host rollable cot with a raisable backrest, said stretcher comprising:

a first board having a first backboard portion, and a first plurality of finger and knuckle portions; and a second board having a second backboard portion, and a second plurality of finger and knuckle portions, said second board is hinged to said first board along a longitudinal side such that said first and second boards are movable between a first condition in which said first and second boards are folded against each other and a second condition in which said first and second boards form a substantially planar patient support surface, wherein said first finger portions of said first board rest upon said second knuckle portions of said second board and said second finger portions of said second board rest upon said first knuckle portions of said first portion, wherein said first and second backboard portions are mounted to said first and second boards, respectively, and configured to permit the backrest of the host rollable cot to be raised when said stretcher is provided thereon in said first condition, wherein said first and second boards each provide a plurality of mounting channels and said stretcher further comprises a plurality of legs removably mounted in said mounting channels, and wherein said first and second boards each further include a securing bar manually moved between a secure position and a release position, said secure position engages said legs accommodated in said mounting channels with said securing bar, and said release position disengages said securing bar from said legs accommodated in said mounting channels.

10. A stretcher and cot assembly comprising:

a stretcher, wherein:

said stretcher comprises a first board and a second board;

said second board is secured to said first board along a longitudinal side such that said first and second boards are movable between a first condition in which said first and second boards form a substantially planar patient support surface, and a second condition in which said first and second boards are folded against each other; and said stretcher further comprises a plurality of mounted legs, said legs are rotatably mounted and movable between an extended position that places said legs perpendicular to said stretcher when in said second condition and a retracted position which places said legs in parallel with said stretcher; and a cot having at least one receptacle member disposed to allow one of said plurality of mounted legs to be secured therein such that said stretcher may be releasably mounted to said cot.

11. The stretcher and cot assembly according to claim 10, wherein said cot has a plurality of receptacle members each disposed to allow one of said plurality of mounted legs to be secured therein.

* * * * *

UNITED STATES PATENT AND TRADEMARK OFFICE

CERTIFICATE OF CORRECTION

PATENT NO. : 6,568,009 B2 
DATED : May 27, 2003
INVENTOR(S) : David R. Linger et al.

It is certified that error appears in the above-identified patent and that said Letters Patent is hereby corrected as shown below:

Column 9,
Line 2, “channels wit said” should be -- channels with said --.

Signed and Sealed this

Fourth Day of November, 2003

JAMES E. ROGAN
*Director of the United States Patent and Trademark Office*